US010589896B2

(12) United States Patent
Ibañez Razola

(10) Patent No.: US 10,589,896 B2
(45) Date of Patent: Mar. 17, 2020

(54) ANTI-SPURT DEVICE

(71) Applicant: Pablo Ibañez Razola, Valencia (ES)

(72) Inventor: Pablo Ibañez Razola, Valencia (ES)

( * ) Notice: Subject to any disclaimer, the term of this patent is extended or adjusted under 35 U.S.C. 154(b) by 51 days.

(21) Appl. No.: 16/089,905

(22) PCT Filed: Apr. 6, 2017

(86) PCT No.: PCT/ES2017/070210

§ 371 (c)(1),
(2) Date: Sep. 28, 2018

(87) PCT Pub. No.: WO2017/174850

PCT Pub. Date: Oct. 12, 2017

(65) Prior Publication Data

US 2019/0375538 A1 Dec. 12, 2019

(30) Foreign Application Priority Data

Apr. 8, 2016 (ES) ..... 201630435

(51) Int. Cl.

| | |
|---|---|
| ***B65D 5/74*** | (2006.01) |
| ***B65D 41/04*** | (2006.01) |
| ***B65D 41/20*** | (2006.01) |
| ***B65D 41/26*** | (2006.01) |

(52) U.S. Cl.

CPC ..... *B65D 5/74* (2013.01); *B65D 41/0407* (2013.01); *B65D 41/0485* (2013.01); *B65D 41/205* (2013.01); *B65D 41/265* (2013.01); *B65D 2205/00* (2013.01); *B65D 2547/06* (2013.01)

(58) Field of Classification Search

CPC .. B65D 5/74; B65D 41/0407; B65D 41/0485; B65D 41/205; B65D 41/265; B67B 7/24; B67B 7/26; B67B 7/28

USPC ..... 222/541.2, 481.5, 80–83

See application file for complete search history.

(56) References Cited

U.S. PATENT DOCUMENTS

| | | | | |
|---|---|---|---|---|
| 1,084,857 A * | 1/1914 | Harris | B65D 47/06 222/479 |
| 1,676,711 A * | 7/1928 | Reap | B65D 25/40 141/309 |
| 2,286,797 A * | 6/1942 | Duerme | A61J 11/02 215/11.3 |
| 3,173,587 A | 3/1965 | Stearns | |

(Continued)

FOREIGN PATENT DOCUMENTS

| | | |
|---|---|---|
| DE | 20 2008 010 645 | 8/2008 |
| GB | 2345688 | 7/2000 |

(Continued)

*Primary Examiner* — Patrick M. Buechner
*Assistant Examiner* — Michael J. Melaragno

(57) ABSTRACT

An anti-spurt device, for application in a closure of a container with a cap and a ring with teeth for cutting a sealing membrane. The anti-spurt device may comprise a tube that automatically unfolds from a folded position and may be connected with the cutting ring. In the folded or loaded position, the tube may be outside of the sealing membrane and with the breakage of the membrane, it may be inserted and automatically unfolded in the inside of the container. In a second main embodiment, the need for a cutting ring and membrane may be eliminated, and the tube may be installed on a carriage held by a hook that is released with the opening of the cap.

24 Claims, 13 Drawing Sheets

(56) References Cited

U.S. PATENT DOCUMENTS 3,584,770 A * 6/1971 Taylor ..... A61J 1/05 222/479
3,610,484 A 10/1971 Matzka
3,613,955 A * 10/1971 Wetherell, Jr. ..... B65D 51/20 222/83
3,901,417 A * 8/1975 Schiemann ..... B65D 1/20 222/479
4,034,901 A * 7/1977 Kirk ..... B44D 3/127 222/481.5
4,120,414 A * 10/1978 Harrison ..... B65D 51/1611 215/307
4,483,464 A 11/1984 Nomura
4,940,152 A * 7/1990 Lin ..... A61J 9/00 215/11.1
4,967,922 A * 11/1990 Alder ..... B65D 47/06 215/309
5,002,202 A * 3/1991 Karpisek ..... B67B 7/26 222/83
5,147,070 A * 9/1992 Iwamoto ..... B65D 5/748 222/541.2
5,232,110 A * 8/1993 Purnell ..... B65D 47/06 215/309
5,366,114 A * 11/1994 Bernstein ..... B65D 5/748 222/83
5,746,358 A * 5/1998 Crosby ..... B65D 47/06 222/479
5,853,114 A * 12/1998 Giovanoli ..... B65D 25/38 222/479
6,279,779 B1 * 8/2001 Laciacera ..... B65D 5/748 222/541.2
6,382,475 B1 * 5/2002 Weikinger ..... B65D 25/42 222/479
6,471,101 B1 * 10/2002 Vardanyan ..... B65D 17/4012 222/541.2
7,337,921 B2 * 3/2008 Ma ..... B65D 41/3428 220/529
7,484,641 B2 * 2/2009 Casale ..... B65D 5/748 220/278
8,016,159 B2 * 9/2011 Ma ..... B65D 41/3428 220/529
8,640,930 B2 * 2/2014 Nunez ..... B65D 77/225 222/1
8,662,358 B2 * 3/2014 Hague ..... B65D 47/32 222/481.5
8,672,167 B2 * 3/2014 Leuenberger ..... B65D 5/748 220/284
9,096,357 B2 * 8/2015 Brausen ..... B65D 47/32
2003/0034363 A1 * 2/2003 Morgenroth ..... B65D 47/06 222/481.5
2004/0108340 A1 * 6/2004 Witt ..... B67D 7/005 222/464.3
2005/0011915 A1 * 1/2005 Dygert ..... B65D 25/2894 222/481.5

FOREIGN PATENT DOCUMENTS

WO 2014046633 3/2014
WO 2014114895 7/2014

* cited by examiner

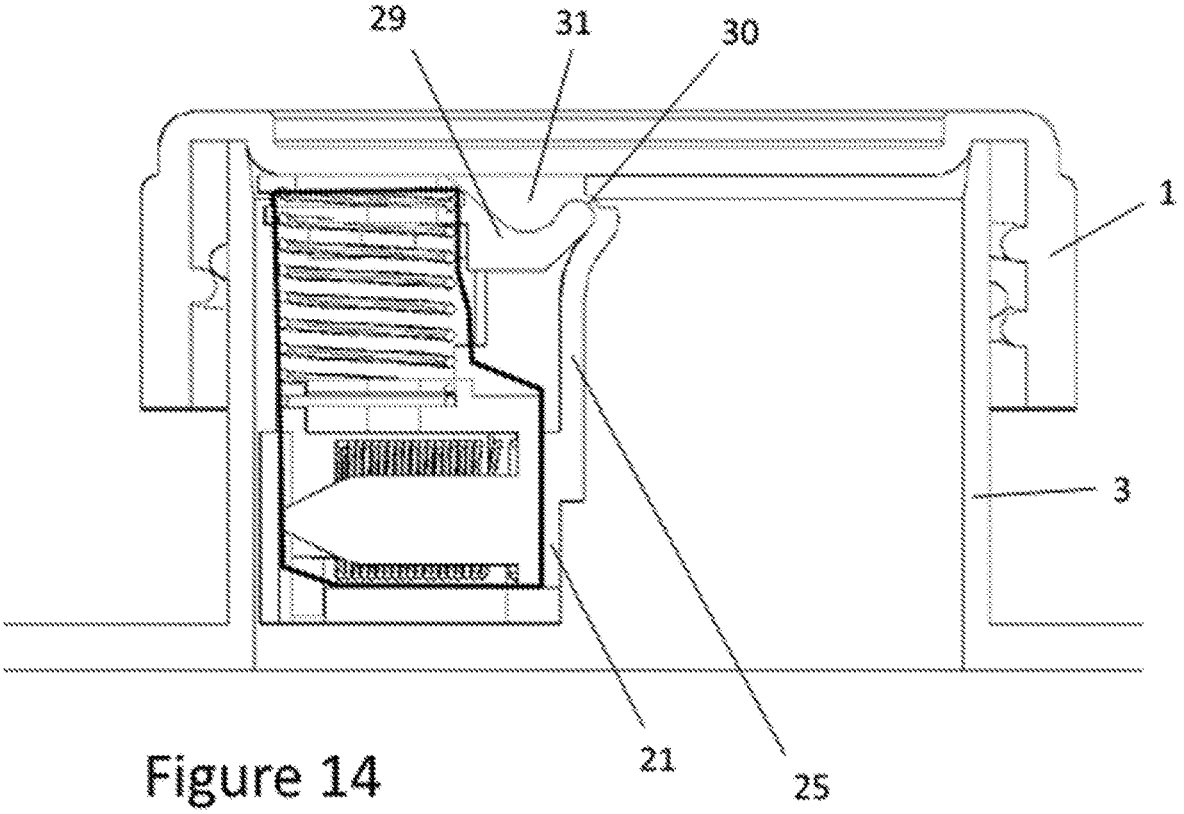
Figure 14
Figure 15
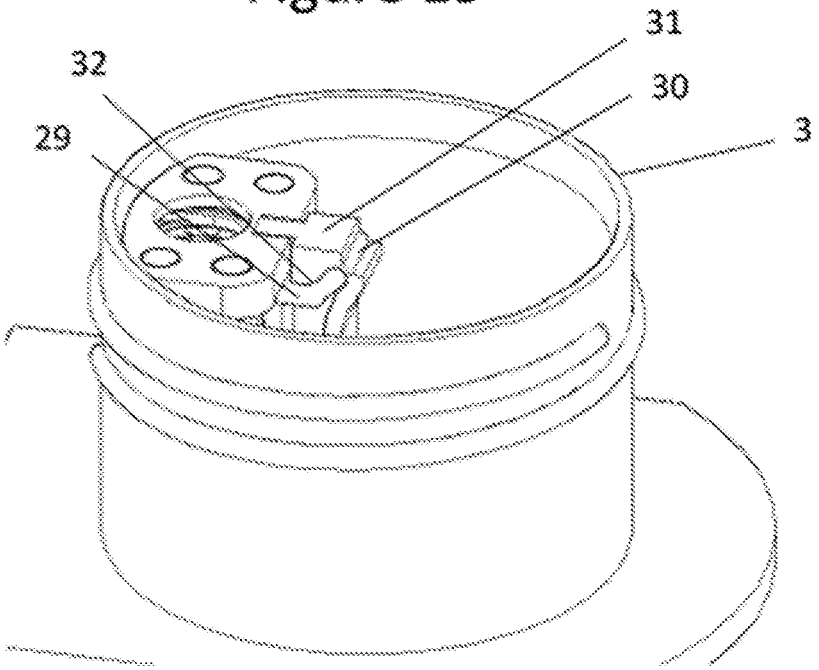

ANTI-SPURT DEVICE

CROSS REFERENCE TO RELATED APPLICATIONS

This application claims priority to the following Patent Application: (1) PCT application PCT/ES2017/070210, filed Apr. 6, 2017; and (2) Spanish patent application P201630435, filed Apr. 8, 2016; the above-identified applications are hereby incorporated by reference in their entirety as if fully set forth herein.

TECHNICAL FIELD

This invention refers to an anti-spurt device, especially for Tetra Brik® container nozzles, or generally any container that has a screw cap in the outflow nozzle and where the cross-section has one dimension greater than the other. Particularly, but not exclusively, if it has a breakable membrane between the outflow nozzle and the inside of the container.

The invention is applicable to the field of packaging, mainly for food.

BACKGROUND OF THE INVENTION

Containers, for example, those made with multi-layer materials such as those called Tetra Brick®, which contain liquids, have an opening system composed of a cap, a threaded nozzle glued to the body of the container and, depending on the type, a ring for cutting the breakable sealing membrane. The container is not usually full of liquid, so on opening it for the first time, some air gets inside. This air forms a bag in the upper part that fills with the emptying of the container.

Because of the geometry of the container and of the nozzle, when pouring, and especially in the first few uses, a vacuum forms inside that increases as the container is emptied. There frequently comes a time when the pressure of the vacuum is enough to suck air from the outside and slow down the outflow of the liquid. This results in a new pressure balance, which facilitates the outflow of new liquid. This continuous effect of vacuum and entry of air causes a series of spurts, or discontinuous flows of liquid, and is generally annoying because the liquid often spills and stains the recipient being filled.

The German patent DE202008010645 offers a solution that involves locating a tube in the nozzle that facilitates communication between the air space and the outside. This system requires a change in the manufacture of the containers and to have foreign components in contact with the liquid from the start, so it is not particularly hygienic.

The French patent FR3001205 on an anti-spurt device comprises a tube included in the cap of the container but in this case outside the sealing and closure membrane, so maintaining the hygiene of the contents. The cap comprises a cutting ring that breaks the membrane when the cap is opened for the first time, and in one embodiment drags the tube so that it serves as a ventilation pathway for the container and reduces the spurting in the outflow. In other embodiments, the tube must be manually deployed, with the hygiene problems that this involves and the risk that the tube remains in an incorrect position within the container and fills with liquid. Again, because of the limited dimensions of the tube, its rotation by 180 degrees towards the inside of the container causes interference with half of the teeth of the cutting ring, so these have been removed. This reduced number of teeth may be a serious problem for proper cutting of the sealing membrane.

This system is not very reliable, so it is relatively easy for liquid to get into the tube and to block it. To counter this, there is a small valve in the inner end but there cannot be anything on the outer end. Similarly, the tube is limited in terms of its dimensions, so it only operates appropriately for specific container sizes.

Furthermore, the tube is attached to the nozzle of the recipient and not to the cutting ring, so there is interference with the arms of the cap that drive the cutting ring. Therefore, the assembly and closures that are performed subsequently by users are difficult. Moreover, the tube forces a redesign in the cutting ring, making it more difficult to break the sealing membrane. Also, the join of the tube with the nozzle above the cutting ring limits the height of the cutting ring, so that the teeth and the threading must be small.

When there is no breakable membrane below the nozzle, it is possible to have a tube such as, for example, in the patent GB2345688, but a choice must be made between making it smaller and less practical or making it larger and less manageable.

It is, therefore, necessary to resolve these problems with the French patent, hence the following invention was developed.

BRIEF DESCRIPTION OF THE INVENTION

The invention consists of an anti-spurt device according to the claims. This device with its alternatives solves the problems with the state-of-the-art.

This invention provides hygiene as an advantage, according to the embodiment, since the components of the invention are not in contact with the contents of the container until its opening. Furthermore, the tube deploys automatically, without the need for contact with external bodies, nor does it require different handling by the user. All the mechanism remains inside the hollow left free by the cap, outside the sealing membrane, and is freed by itself when the container is opened, so that users do not have to do anything different from what they do now.

By being extensible, the connection between the air space and the outside is total, so the fluid flows out smoothly from the first use.

Finally, by applying the system to the cutting ring, it is not necessary to affect any existing component, so taking advantage of the already optimised design of the cutting ring. As the cutting ring remains below the wings or arms of the cap, once the container is fully open, the cutting ring will always remain below the wings or arms of rotation of the cap, and consequently, there will be no interference between these wings and the tube during successive uses of the container.

In the second embodiment, it is independent of the sealing membrane, so this can be applied to containers that do not have a membrane, or in the case where the membrane is above the nozzle (between the nozzle and the cap). In this case, apart from several of the previous advantages, it is conveniently small and easy to install.

The anti-spurt device of the first main embodiment is similar, therefore, to the French document, insofar as it has a tube, with a longitudinal segment parallel to the axis of the nozzle (generally vertical, so this term will be used to refer to it) topped in an aspiration opening and a transversal segment to the axis of the nozzle (normally horizontal, although in this case there may be some variation within the invention, independently of the real position) with the air expulsion opening in the free end. This tube is connected to one or more arms for engaging with the cutting ring so it can descend simultaneously with it. But in contrast to the existing system, the tube is unfolded to increase the efficacy. That is, the dimensions of the tube are variable, being compressed, folded or similar (that is, with a size smaller than the corresponding final position) when the container is still not opened.

The preferred way of performing this unfolding is by means of a pair of springs covered by an impermeable film, that form the cited segments. The springs are generally helical, and their cross-section may be circular, oval, rectangular, etc. Preferably, the vertical spring, that conforms the vertical segment, is truncated-conical or truncated-pyramidal in shape.

An accumulation bag can be made in the lower part of the elbow of the tube (that is, the join between the two segments).

Preferably, the vertical segment is joined to the cutting ring, but has an extension above it.

In the elbow part, there may be a connector that joins the two segments together. This connector may include components that establish the direction of the segments, hereafter called guides, and their function is to contain the spring so that it does not escape or unfold towards the two sides. There may be a pair of components that contact with the internal or external walls of the segment itself or of the corresponding spring.

To facilitate unfolding, guides can be made in the arm or arms of the cutting ring, which can work together with a carriage connected to the elbow of the tube. This carriage may have a hook that connects to the upper edge of the cutting ring (including any component fused to it, such as the anchoring point or feet or a fixing support for the vertical segment to these arms), but working against a return tension that tends to release the hook.

The carriage may equally comprise a gate, hinged horizontally or vertically, that is placed in front of the free end of the horizontal segment of the tube, in its folded position, so that the upper edge of the gate is above the upper edge of the teeth. In this way, the gate cannot be opened to impede the cutting ring before the unfolding and the descent of the carriage below the cutting ring has started.

In the second main embodiment, the tube is also contained within the cap in a folded position, but in contrast to the previous case, it is independent of a possible cutting ring and the sealing membrane. Instead, the folded tube is retained directly by the cap or by a possible sealing membrane glued between the nozzle and the cap.

This second embodiment is applicable to a closure of a container formed by a cap threaded on a nozzle, without the need for a membrane or a cutting ring, although they may also be present. The closure also contains a tube, with a vertical segment parallel to the axis of the nozzle topped in an aspiration opening and a horizontal segment with an air expulsion opening at the free end. As in the previous case, the tube is automatically unfolded. Just as in an alternative of the previous main embodiment, the tube is carried by a carriage, moving along guides, in this case, linked to the inner face of the nozzle. The carriage comprises a hook fixed by its upper end to a notch of a grip fused to the nozzle so that the rotation of the cap releases the hook.

Two non-limiting examples of achieving this release are listed below. In the first, the hook comprises a hinge at its free end connecting to a final head, of greater cross-section than the hinge. In turn, the cap in the closed position is next to the grip, leaving a space of a size smaller than the head. That is a space or tolerance where the head cannot pass through.

In the second example, the hook is rigid and is held by the grip while the cap has a pin for releasing the hook. In the movement of opening the cap, the pin pushes the hook out of the grip.

All the alternatives of the tube, the carriage and other components of the first main embodiment are applicable to the second embodiment, provided that they do not refer to the cutting ring or to the membrane. As indicated above, these components may also be present, although with functions that are somewhat different from those exercised in the first main embodiment.

DESCRIPTION OF THE FIGURES

The following figures are included for a better understanding of the invention.

FIG. 14: schematic cross-section view of a first example of an embodiment of a second main form of embodiment, that does not require the cutting ring or the membrane.

FIG. 15: a perspective view, half-exploded, of the example of FIG. 14, in the position corresponding to closure, but without the cap that prevents a clear view.

METHODS OF THE EMBODIMENT OF THE INVENTION

Figure 1:
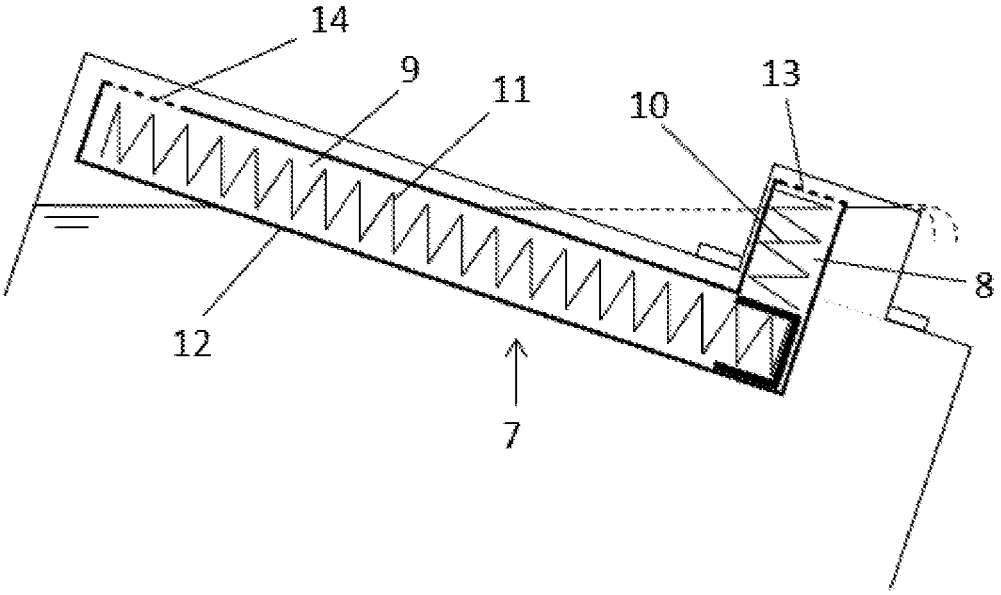
FIG. 1: schematic side view of an embodiment of the invention.
Figure 2:
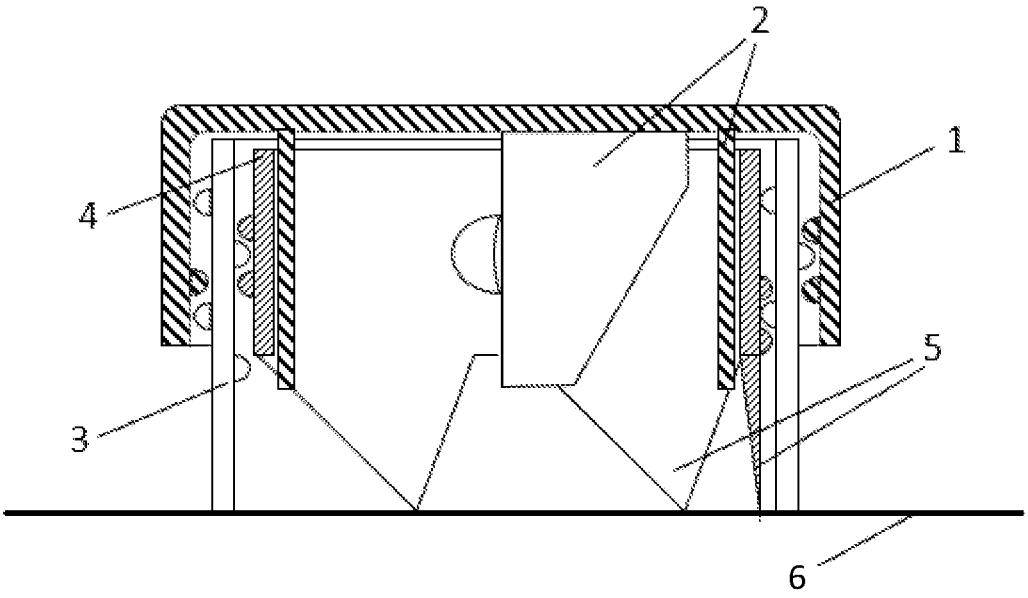
FIG. 2: closure according to a usual solution in the state-of-the-art, without any component of the device.
Figure 3:
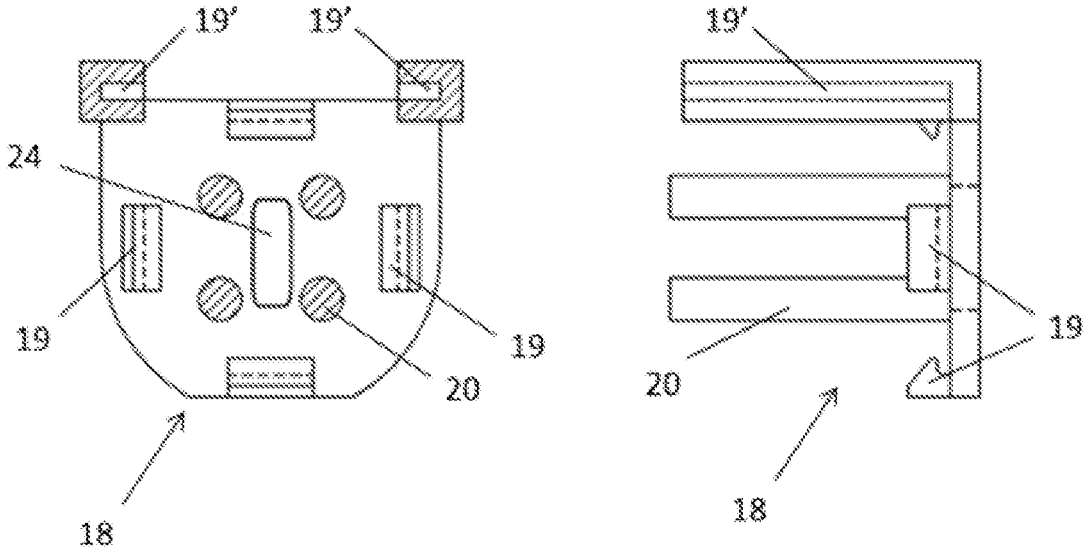
FIG. 3: two views of an example of the connector for the elbow.

One method of the embodiment, as an illustrative, non-limiting example of the invention is briefly described below.

The invention shown in the embodiments of FIGS. 1 to 13 is an anti-spurt device for containers, for example, Tetra Brik® or similar. It is formed by a closure similar to those existing in the state-of-the-art, to which components are added to aerate the inside during pouring. The closure comprises a threaded cap (1) with a series of wings (2) arranged towards the inside. It also comprises a nozzle (3) fixed to the body of the container and with an external thread corresponding to that of the cap (1). The nozzle (3) also presents an inner thread in a direction opposed to the exterior thread. A cutting ring (4) is mounted in the inner thread with teeth (5) in one part of its lower border, that can break a sealing membrane (6) on the container, arranged between the cutting ring (4) and the inside of the container. Normally these teeth (5) cover more than half of the lower border of the cutting ring (4) and the space they leave without cutting serves to leave a piece of the cut membrane (6) linked by a bridge to the rest.

By rotating the cap (1), the wings (2) drive the cutting ring (4), which rotates in the inner thread of the nozzle (3) but advancing in the opposite direction to that of the cap (1), inserting itself into the container. In this way, the teeth (5) sink into the membrane (6) and tear, break or cut it.

To this cap (1), already known in the state-of-the-art, the invention adds a system for deploying a tube (7), generally "L" shaped, that unfolds from the inside of the cutting ring (4). In this way, the system moves together with the cutting ring (4) so it is not necessary to modify the wings (2) or the teeth (5) with respect of the system already known in the state of the art. Furthermore, the invention allows having a longer tube length than that of the French system, obtaining higher effectiveness.

The tube (7) has a vertical segment (8), parallel to the axis of the nozzle (3), and a horizontal segment (9), approximately perpendicular to this axis. Both can unfold, preferably by having a pair of springs (10, 11) inside covered by an impermeable film (12) that gives shape to the tube (7). The springs (10, 11) can have square, rectangular, round or any other type of cross-section shape, but it is recommended that they are truncated conical or truncated pyramidal to occupy the minimum space when folded.

It is also possible to make the tube (7) using folded flexible components: the tube (7) itself in a spiral (FIG. 12), an internal zigzag spring, etc. In this case, it would be useful if the horizontal segment (9) did not easily fold downwards, but did so towards the sides (through reinforcements (28) in the upper and lower area of the wall of the tube (7) or internal to it (FIGS. 12 and 13)). In this way, it could be kept folded within the nozzle (3) but the free end of the horizontal segment (9) would not fall by its own weight when deployed, despite being only fixed at one end.

Figure 10:
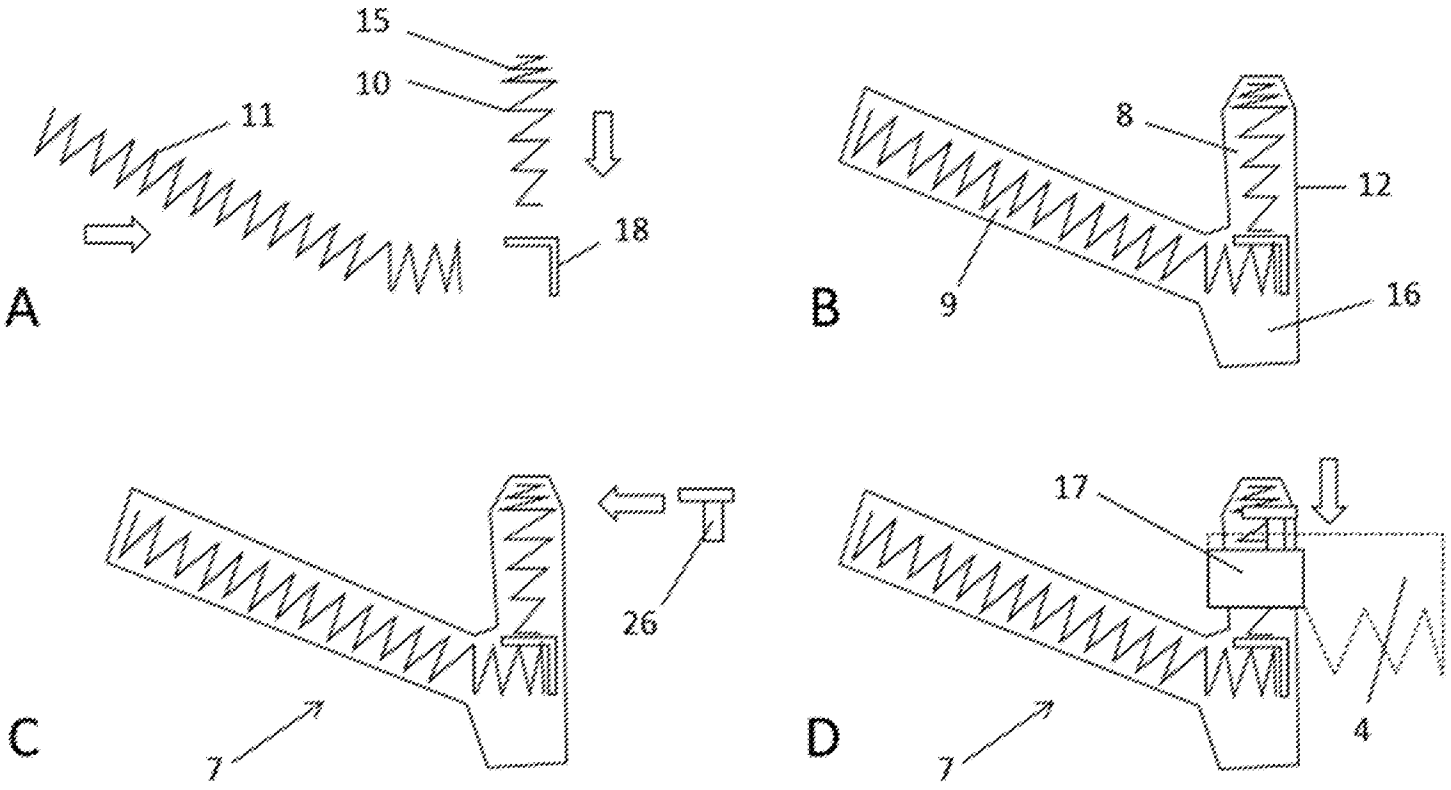
FIG. 10: first stages of the assembly of the device, according to one embodiment.

It is also possible to tilt up the horizontal segment (9) so that the free end is higher and therefore further from the level of the liquid (FIG. 10).

The vertical segment (8) emerges through the nozzle (3) to aspirate the air by an aspiration opening (13), while the horizontal segment (9) connects with the airspace by an air expulsion opening (14). Between the two there is an elbow, as described below. Each of the segments (8, 9) have their own spring (10, 11), although these may be a single helicoidal metal spring, with the mentioned elbow.

The aspiration opening (13) of the vertical segment (8) remains higher than the cutting ring (4), preferably comprising a conical or pyramidal extension (15), that extends its length beyond the cutting ring (4). This extension (15) is folded when the cap (1) is put on for the first time in the factory. On subsequent replacements of the cap (1) after its first use, the cutting ring (4) remains at a lower level and the extension (15) of the aspiration opening (13) does not emerge beyond the nozzle (3).

The openings (13, 14) can be two single holes (FIG. 9) or a number of perforations (FIG. 1), which reduces the risk of entry of liquid that may block the tube (7). The expulsion opening (14) is preferably orientated upwards for the same reason.

The tube (7) can have an accumulation bag (16) or a small collection tank in the lower part of the elbow, for any liquid that accidentally enters it. For example, this can be performed by a widening of the film (12) in this zone.

Before the container is opened for the first time, the tube (7) is compressed and "loaded" within the nozzle (3). The membrane (6) restrains its unfolding. With the breakage of the membrane (6) by the cutting ring (4), the restraint to the unfolding is removed and the tube passes through the lower border of the cutting ring (4), generally through the zone free of teeth (5), as this is the simplest. It must locate itself so that at the end of the travel of the cutting ring (4), pushed by the wings (2), the horizontal segment (9) is orientated towards the opposite side to the natural pouring position. This implies that the vertical segment (8) is arranged by the upper part in this natural position. In the case of a Tetra Brik®, the horizontal segment (9) is orientated towards the edge of the upper base furthest from the nozzle (3).

Figure 8:
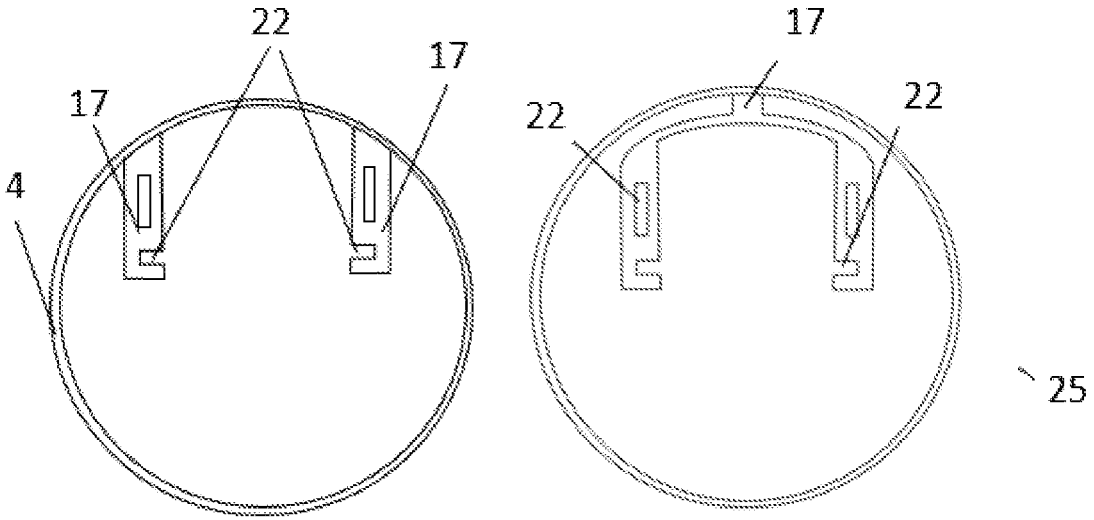
FIG. 8: top view of the two cutting rings of the invention with one or two arms, according to the two examples of embodiment.
Figure 9:
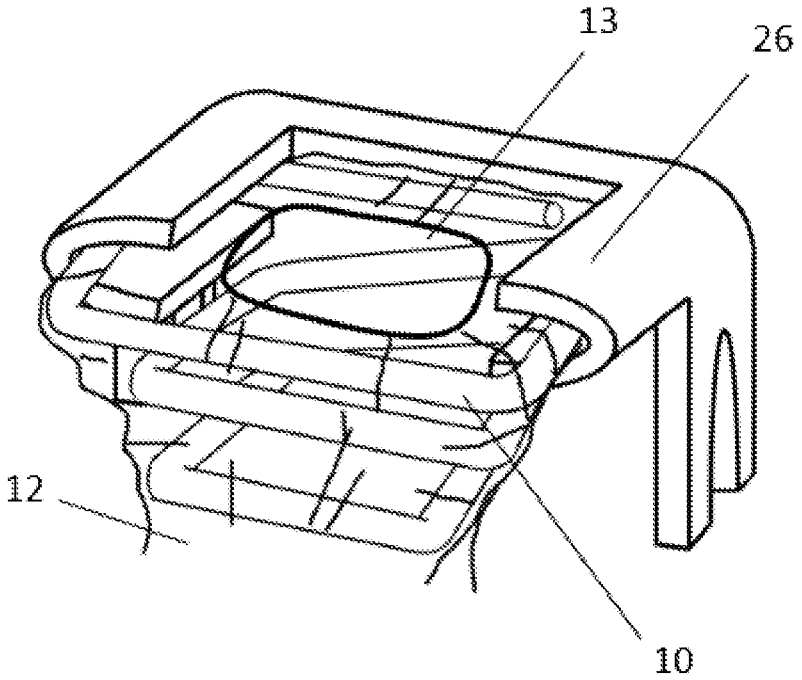
FIG. 9: a perspective view of an example of the support for the vertical segment.

It is advisable to have some clips or arms (17) in the cutting ring (4) that engage and drag the tube (7) in the folded position with its rotation (FIG. 8).

In order to keep the tube (7) folded, and to direct its unfolding, it is proposed to have a series of optional auxiliary components.

When the segments (8, 9) that make up the compressible structure of the tube (7) are independent, an intermediate connector (18) is required in the elbow that connects them. The fixing of each segment (8, 9) depends on the components of which they are made. For example, if they comprise springs (10, 11), there could be tabs (19) or fixing slots (19') in them. It could also be an adhesive, plastic weld, or it could be made of a single item with one of the two segments (8, 9). If the tube (7) is single, the intermediate connector (18) can be eliminated or a curve made to generate the elbow section, preventing the tube (7) from strangulating.

In turn, the connector (18) can serve to ensure the orientation of the horizontal segment (9) in its folded or compressed position, for example, keeping the horizontal spring (11) in position by guides (20), whether internal (FIG. 3) or external, for example a drawer (not shown).

For the vertical movement of the tube (7), there may be a carriage (21) linked to it that moves on guides (22) set in the arms (17) of the cutting ring (4). The first function of the carriage (21) is to prevent the tube (7) in the folded position from being displaced by the effect of the force of the horizontal segment (9) against the wall of the cutting ring (4). Without this carriage (21), the compressed tube (7) might slip out through the teeth (5) or above the cutting ring (4), or there might be a jam due to the release of the tube (7) towards the sides or upwards.

In turn, the carriage (21) and the guides (22) ensure that the movement of unfolding is performed correctly towards the inside of the container when the membrane (6) is cut.

The carriage (21) can be fused to the connector (18) or be directly attached to the tube (7).

Figure 4:
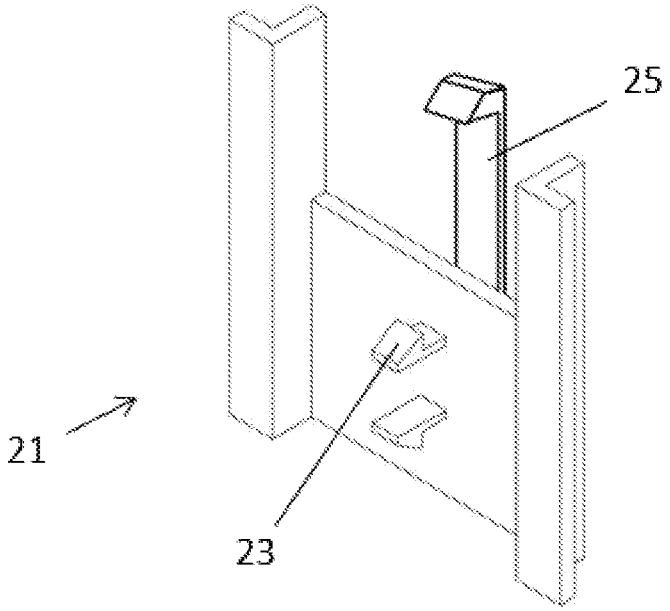
FIG. 4: a first example of a carriage.
Figure 5:
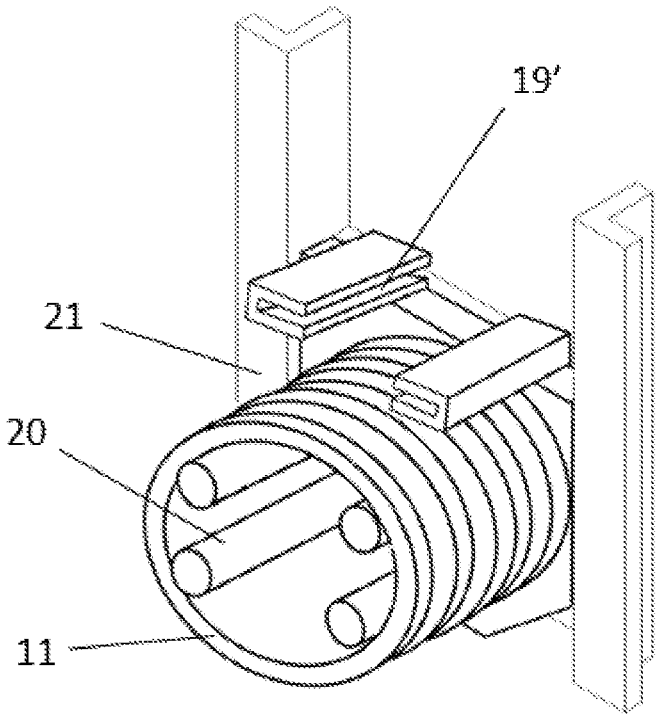
FIG. 5: the example of the carriage of the previous figure, fixed to the connector of FIG. 3 and with a horizontal spring in the compressed position.
Figure 6:
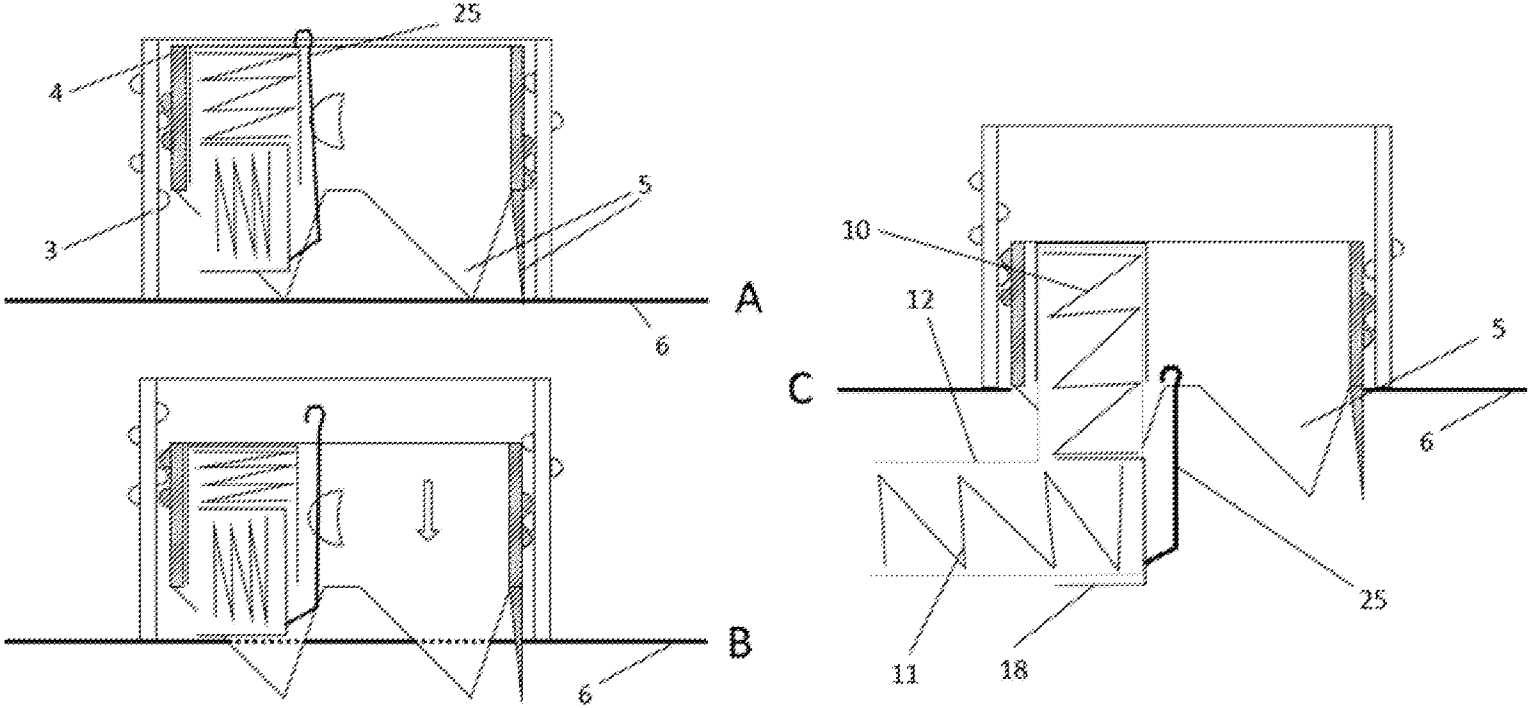
FIG. 6: schematic cross-section views of the device, according to an embodiment, showing the operation of the hook: A) in the initial position; B) with the start of the breaking of the membrane; C) after the full breakage of the membrane.
Figure 7:
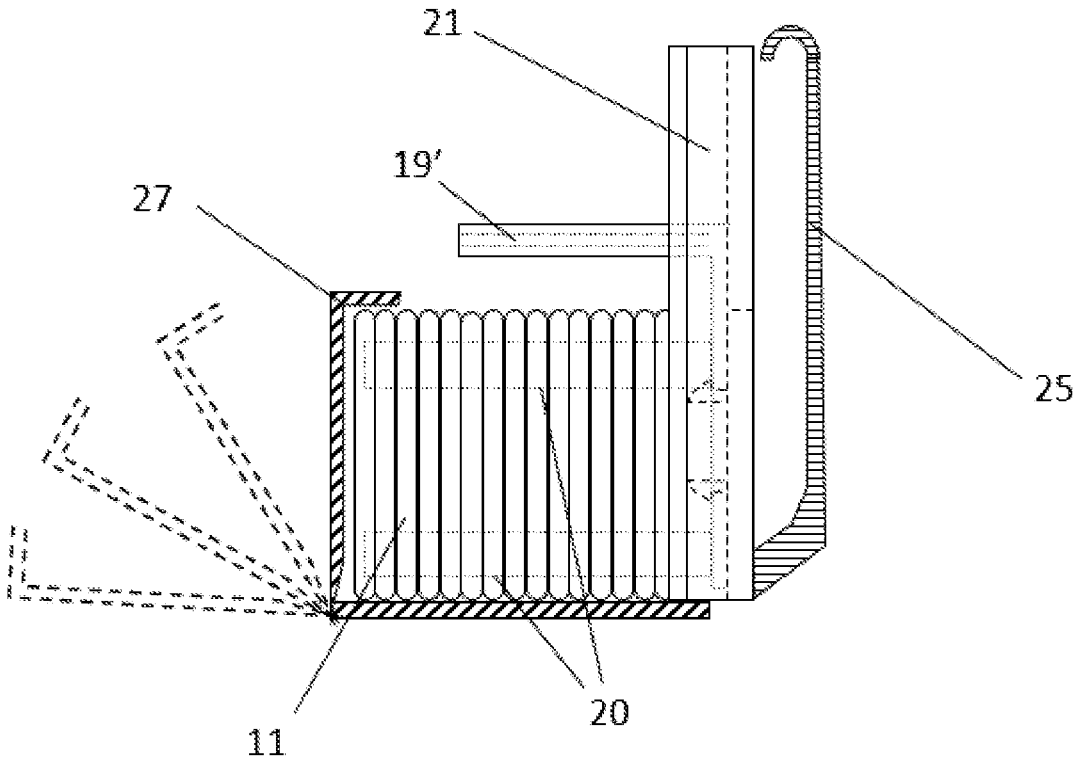
FIG. 7: side view of an example of the carriage with a gate, with a horizontal spring compressed and with the fixing hook of the mechanism.

FIG. 4 shows some tabs (23) for joining to a hole (24) of the connector (18). In FIG. 5, the join has already taken place, in addition to the coupling of the horizontal spring (11), although the figure does not show the film (12), which remains captive between the carriage (21) and the connector (18).

The carriage (21) can have an additional restraining mechanism of one or more hooks (25) for fixing to the upper edge of the cutting ring (4) or some component fused to it, preferably a single hook (25). In the fixed position, the hook (25) is in a somewhat forced position, or in tension, so that its natural position (without tensions or forces) is away from its hooking point. Thus, the hook (25) is automatically released at the start of the opening of the container, at the moment in which the tube (7), fused with the cutting ring (4), presses towards the sealing membrane in its movement towards the inside of the container.

The hook (25) helps to prevent the carriage (21) from running along and leaving its guides (22) even when the membrane (6) is not in position. That is, it facilitates the assembly of the whole mechanism, which is held together and loaded within the cutting ring (4) even before its assembly with the container.

As can be seen schematically in FIGS. 6A to 6C, the hook (25) in the initial position is linked to the upper edge of the cutting ring (4) or to any component fused to it (FIG. 6A). At the start of the opening, the teeth (5) penetrate the membrane (6), so the cutting ring (4) descends gently. However, the carriage (21) cannot descend because the membrane (6) still prevents it. Therefore, although the upper edge of the cutting ring (4) has descended, the hook (25), fused to the carriage (21), still has not done so and can be released (FIG. 6B). At this point, the system is free of anchors and is only sustained by the sealing membrane (6), the vertical segment (8) being even more folded or compressed than in its initial state. On continuing with the opening, the cutting ring (4) finishes breaking the membrane (6) and the carriage (21) is automatically released, descending along the guides (22) driven by the unfolding of the vertical segment (8) of the tube (7). When the elbow goes beyond the lower edge of the cutting ring (4), the horizontal segment (9) automatically unfolds and remains in its final position (FIG. 6B).

The vertical segment (8) of the tube (7) must be attached to the cutting ring (4), for example to the cited arms (17). To do this, it may have a support (26), preferably independent of the arms (17) but fixable to them, to facilitate the assembly of the mechanism. The vertical spring (10) can be fixed to the support (26) via some slots. The support (26) can comprise a receptor for the hook (25) (not shown) that may be a depression, a tab, etc., to define the hooking point of the hook (25).

The horizontal segment (9) in the folded position is directed against the cutting ring (4), generally in a zone without teeth (5). As a result of vibration, knocks or during assembly, it is possible that it is displaced below the cutting ring (4), through the space left free by the teeth (5), starting its unfolding and causing a jam. To prevent this, a gate (27) can be arranged in front of the free end of the horizontal segment (9). This gate (27) is hinged in the lower part of the carriage (21) as shown in the figures, or to one side. The upper edge of the gate (27) is above the upper edge of the teeth (5) when in the loaded position. This, therefore, prevents the unfolding of the horizontal segment (9) of the tube (7) before the membrane (6) has been broken.

The wings (2) of the cap (1) do not require modification if the size of the device is small or if there is a cutting ring (4) as can be seen in the right part of FIG. 8. If it needs to be made somewhat larger, it may be necessary to modify the arrangement of the wings (2). In the state-of-the-art, there are often three wings (2) in an equilateral triangle; in the invention, it may be necessary to reduce it to two wings (2) or to arrange them in a different geometry. The cutting ring (4) often has protrusions for contact with the wings (2) in the state-of-the-art, enabling the use of the arms (17) to replace one of these protrusions.

Figure 11:
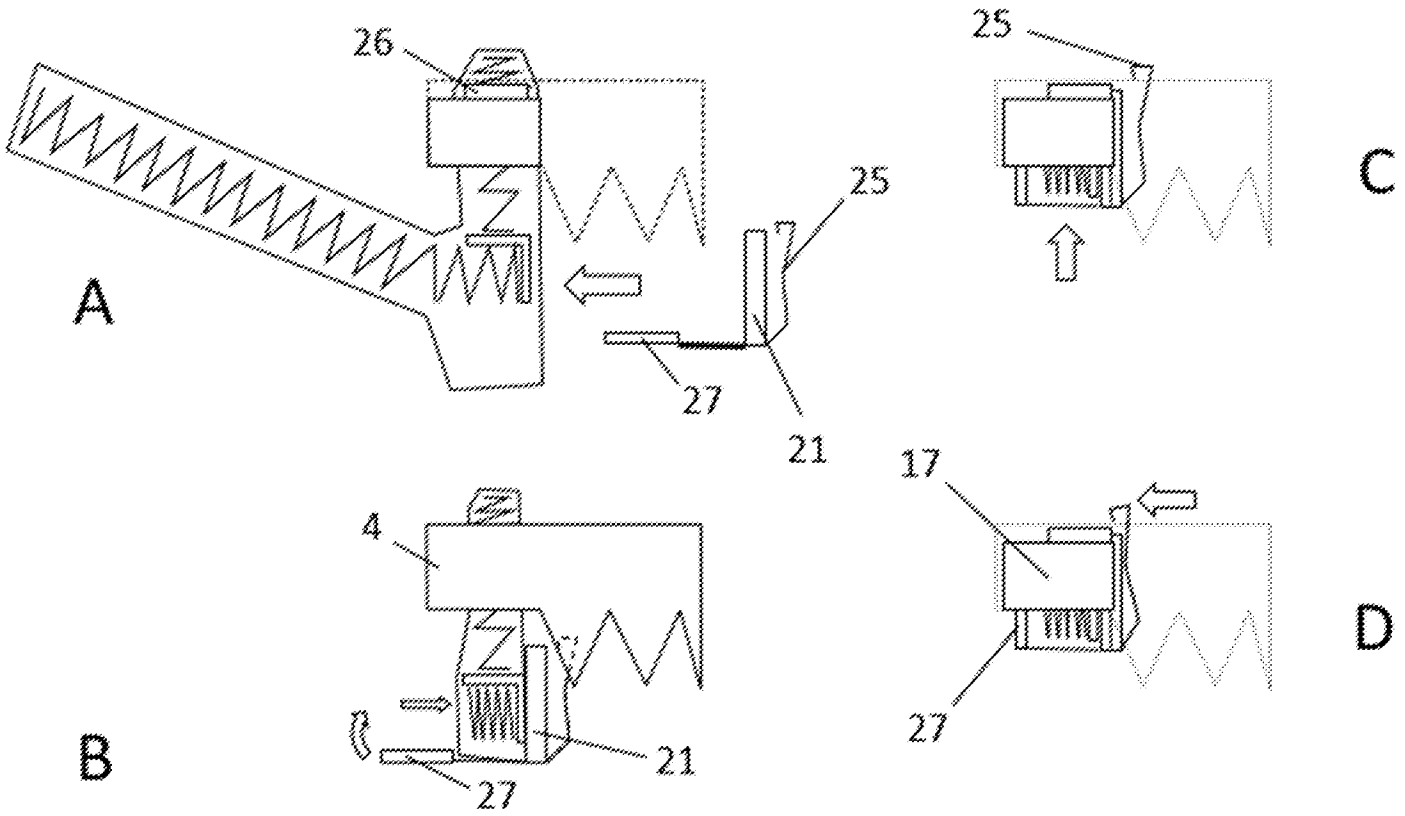
FIG. 11: the remainder of the stages of the assembly of the device, according to the embodiment of FIG. 10.
Figure 12:
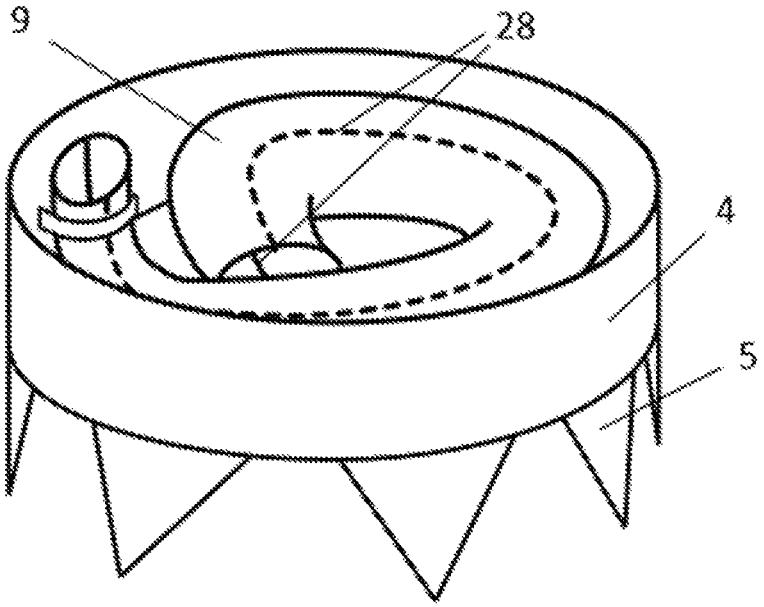
FIG. 12: an example of an embodiment without springs in the tube.
Figure 13:
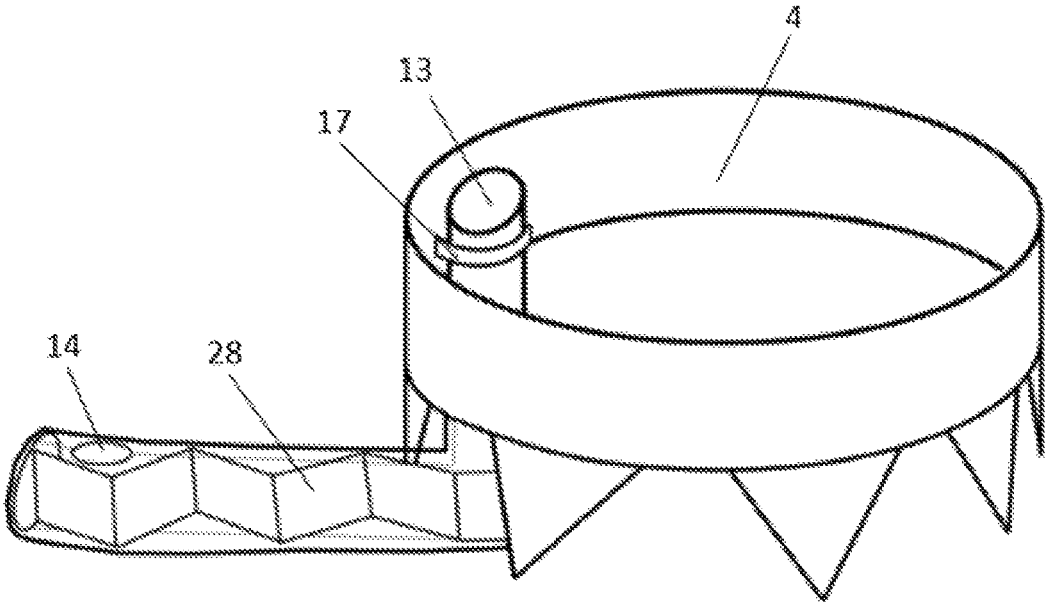
FIG. 13: a second example of embodiment without helicoidal springs.

FIGS. 10 and 11 show the stages of assembly of the most complete embodiment of the invention. In parts of these figures, the cutting ring (4) has been shown transparently in order to facilitate understanding.

1. Assembly starts with forming the springs (10, 11), either with a single component or using a connector (18) (FIG. 10A).
2. The film (12) is arranged to wrap around the springs (10, 11) and the connector (FIG. 10B).
3. The vertical spring (10) is fixed in the support (26), FIG. 10C, which is fixed to the arms (17) of the cutting ring (4) (FIG. 10D).
4. The carriage (21) is placed in position, joining it to the connector (18) if applicable. If this assembly must perforate the film (12), this will be performed with tightening to keep the assembly sealed. However, it is preferable not to perforate the film (12), eliminating edges and tips and leaving a margin or tolerance between the components for locating the film (12) (FIG. 11A).
5. The horizontal spring (11) is compressed, closing the gate (27) (FIG. 11B), and the carriage (21) is inserted into the guides (22) (FIG. 11C), until the hook (25) can be hooked into the support (26) (FIG. 11D). In this position, the lowest rigid component of the invention, generally a part of the carriage (21), remains at the level of the teeth (5) of the cutting ring (4).

In the second main embodiment, shown in FIGS. 14 to 18, the device is kept in the folded position by means of the hook (25), and its unfolding is automatically performed with the removal of the cap (1) or of the sealing membrane located between the cap (1) and the nozzle (3). Therefore, neither the cutting ring (4) nor the membrane (6) of the previous version are required (although they can be kept). This implies that the guides (22) of the carriage (21) are not arranged on the arm or arms (17) of the cutting ring (4) but are fused to the inner face of the nozzle (3).

Figure 16:
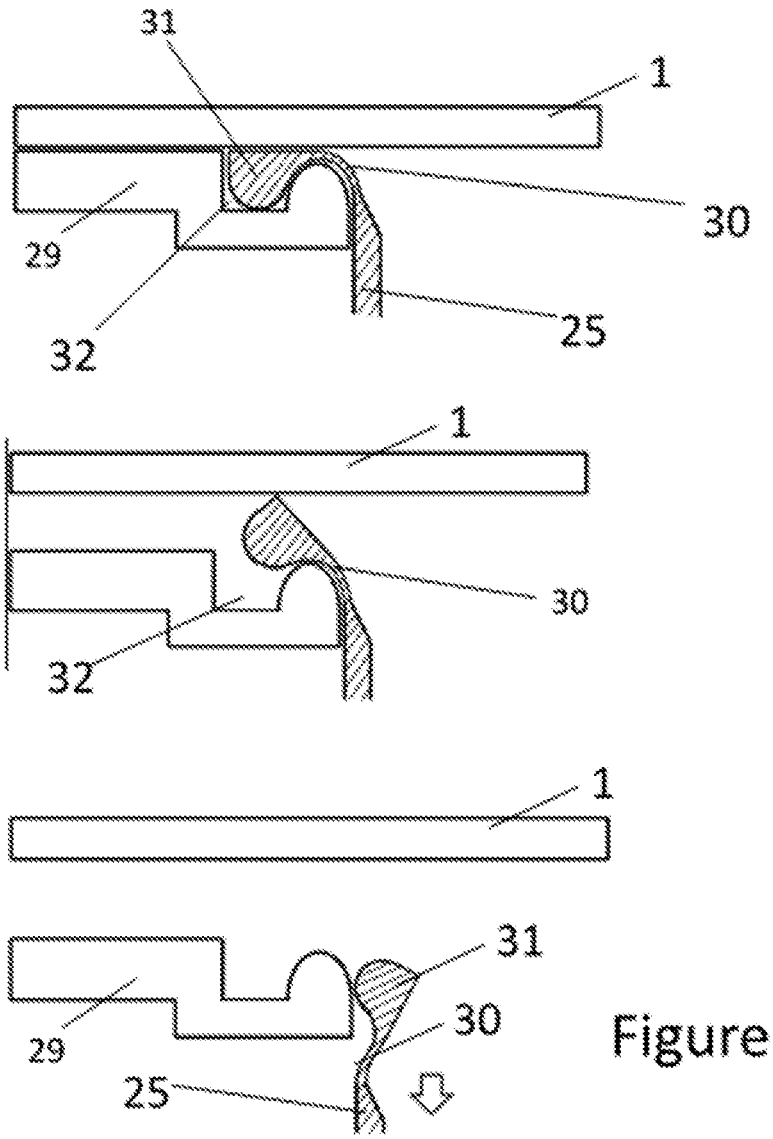
FIG. 16: view of the stages of release of the example of FIG. 14.

FIGS. 14 to 16 show a first fixing system for the carriage (21), similar to that described before and comprises a hook (25) fixed to an internal grip (29) of the nozzle (3). In this case, the hook (25) is not rigid but has a hinge (30) and a head (31) of larger dimensions than the hinge (30). The head (31) is housed in a hole or notch (32) of the grip (29). The grip (29) is adjacent to the upper opening of the nozzle (3) so that the head (31) cannot escape by the remaining space between the cap (1) or upper sealing membrane (not shown) in a closed position and the grip (29). On removing the cap (1), or upper sealing membrane, the head (31) can rise because of the hinge (30). Thus, it cannot stop the force of unfolding of the tube (7), either by the vertical spring (10) or by the selected medium (FIG. 16). This solution is compatible with the presence of a cutting ring (4) and a sealing membrane (3) or with an upper sealing membrane.

Figure 17:
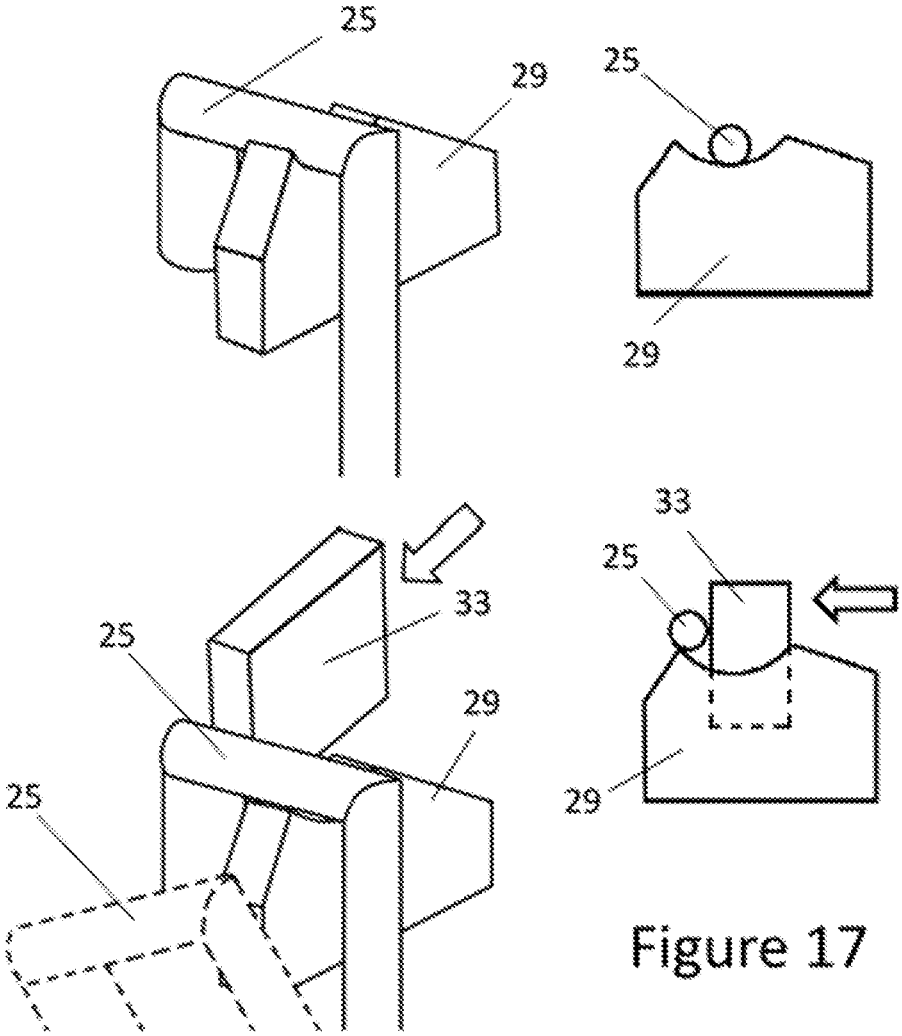
FIG. 17: schematic cross-sectional view of a second example of an embodiment of the second main form of the invention.
Figure 18:
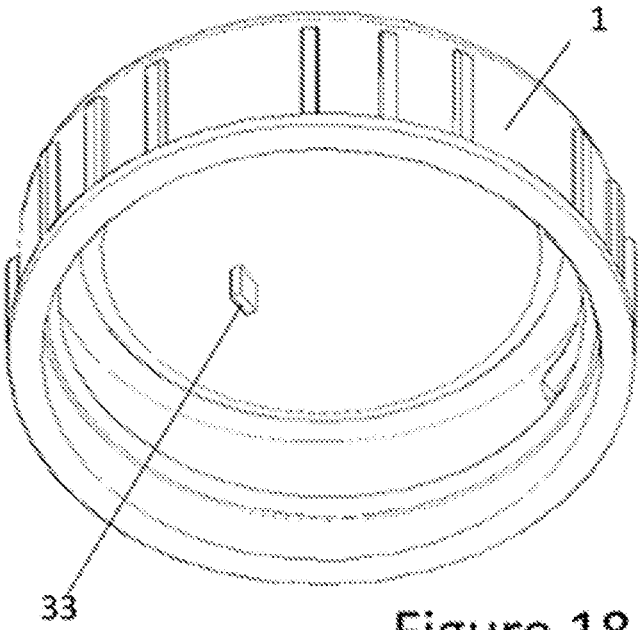
FIG. 18: a bottom perspective view of an example of a pin applicable to a cap for the example of FIG. 17.

The alternative of FIGS. 17 and 18 offers a hook (25) that is still rigid and a grip (29) arranged next to the cap (1). In contrast to the previous case, it is not essential that the distance between the grip (29) and the cap (1) prevents the passage of the hook (25), although this continues to be recommendable. The way of releasing the hook (25) continues by it emerging from the notch (32) of the grip (29), but in this case, it is pushed out by a pin (33) attached to the inner face of the cap (1). On turning this cap (1), the pin (33) pushes the hook (25) outside of the notch (32) (discontinuous line in FIG. 17), taking advantage of the fact that the cap (1) has slightly separated from the nozzle (3) to open the passage for the hook (25). This solution is not compatible with an upper sealing membrane because the pin (33) needs to cross it in a closed position. However, it is perfectly compatible with a lower sealing membrane (6) and a cutting ring (4).

The tube (7), and carriage (21) and the connector (18) of this second main embodiment may comprise all the alternatives described for the first main embodiment, as indicated in the corresponding claims.

The invention claimed is:

1. Anti-spurt device in a closure of a container formed by a cap threaded onto a nozzle, comprising: a cutting ring with teeth on the lower part and a sealing membrane, in such a way that the first rotation of the cap drives the cutting ring to break the membrane, and where the closure contains a tube, with a vertical segment parallel to the axis of the nozzle topped by an aspiration opening and a horizontal segment with an expulsion opening for the air on its free end, connected to one or more arms for engaging with the cutting ring for its simultaneous descent, the tube is automatically unfolded and is folded prior to the breakage of the membrane.

2. The device according to claim 1, wherein the segments are made of a pair of springs covered by an impermeable film.

3. The device according to claim 2, wherein at least one of the springs is helicoidal of rectangular cross-section.

4. The device according to claim 2, wherein it comprises an accumulation bag in the lower part of the elbow of the tube.

5. The device according to claim 2, wherein the vertical spring has a truncated pyramidal or truncated conical shape.

6. The device according to claim 2, wherein the vertical segment has an extension above the cutting ring.

7. The device according to claim 1, wherein the openings have multiple small-sized perforations.

8. The device according to claim 1, wherein it comprises a connector for the segments in the elbow of the tube.

9. The device according to claim 7, wherein the connector has guides for the horizontal segment.

10. The device according to claim 8, wherein it has a carriage connected to the elbow of the tube that can move along guides arranged in the arm or arms of the cutting ring.

11. The device according to claim 10, wherein the carriage comprises one or more hooks that connect with the upper edge of the cutting ring or with a component fused to it, against a return tension.

12. The device according to claim 10, wherein the carriage comprises a gate, arranged in front of the free end of the horizontal segment and where the upper edge is above the upper edge of the teeth of the cutting ring.

13. The device according to claim 1, that comprises a support for fixing the vertical segment connected to the arm or arms of the cutting ring.

14. Anti-spurt device for application in a container closure formed by a cap threaded onto a nozzle, comprising: where the closure contains a tube, with a vertical segment parallel to the axis of the nozzle topped by an aspiration opening and a horizontal segment with an expulsion opening for air at the free end, the tube is automatically unfolded from a position of closure in which it is folded and is conveyed by a carriage that moves along guides connected to the inner face of the nozzle and the carriage comprises a hook fixed by its upper end to a notch of a grip fused to the nozzle, so that the act of rotating the cap releases the hook.

15. The device according to claim 14, wherein the hook comprises a hinge in its free end for connecting to a final head of greater cross-section than the hinge and that has a cap and/or upper sealing membrane that in the closed position is next to the grip, leaving a space of smaller size than the head.

16. The device according to claim 14, wherein the hook is rigid and the cap has a pin for releasing the hook in the movement of opening.

17. The device according to claim 14, wherein the segments are made of a pair of springs covered by an impermeable film.

18. The device according to claim 17, wherein, at least, one of the springs is helicoidal of rectangular cross-section.

19. The device according to claim 17, wherein it comprises an accumulation bag in the lower part of the elbow of the tube.

20. The device according to claim 17, wherein the vertical spring has a truncated pyramidal or truncated conical shape.

21. The device according to claim 14, wherein the openings have a multitude of small-sized perforations.

22. The device according to claim 14, wherein the carriage is fused to a connector of the segments arranged in an elbow of the tube.

23. The device according to claim 22, wherein the connector has some guides for the horizontal segment.

24. The device according to claim 14, wherein the carriage comprises a gate that in the closed position is arranged in front of the free end of the horizontal segment, with its upper edge above the lower edge of the nozzle.

* * * * *